US009527130B2

(12) United States Patent
Haake et al.

(10) Patent No.: US 9,527,130 B2
(45) Date of Patent: Dec. 27, 2016

(54) METHOD FOR PRODUCING CODING SURFACES FROM A BLANK

(71) Applicants: André Haake, Stadtlohn (DE); Oliver Haake, Stadtlohn (DE); Patrick Haake, Vreden (DE)

(72) Inventors: André Haake, Stadtlohn (DE); Oliver Haake, Stadtlohn (DE); Patrick Haake, Vreden (DE)

( * ) Notice: Subject to any disclaimer, the term of this patent is extended or adjusted under 35 U.S.C. 154(b) by 0 days.

(21) Appl. No.: 15/047,663

(22) Filed: Feb. 19, 2016

(65) Prior Publication Data

US 2016/0167114 A1 Jun. 16, 2016

Related U.S. Application Data

(63) Continuation of application No. PCT/EP2014/066192, filed on Jul. 28, 2014.

(30) Foreign Application Priority Data

Aug. 28, 2013 (DE) ..... 10 2013 109 320

(51) Int. Cl.

| | |
|---|---|
| ***B22C 7/02*** | (2006.01) |
| ***B22C 9/04*** | (2006.01) |
| ***B22D 25/02*** | (2006.01) |
| ***B22C 9/22*** | (2006.01) |
| ***B22C 9/18*** | (2006.01) |
| ***E05B 17/00*** | (2006.01) |

(52) U.S. Cl.

CPC . *B22C 7/02* (2013.01); *B22C 9/04* (2013.01); *B22C 9/18* (2013.01); *B22C 9/22* (2013.01); *B22D 25/02* (2013.01); *E05B 17/0004* (2013.01)

(58) Field of Classification Search

CPC ..... B22C 7/02; B22C 7/023; B22C 9/04; B22C 9/043; B22C 9/046; E05B 17/0004

USPC ..... 164/34, 35, 45

See application file for complete search history.

(56) References Cited

U.S. PATENT DOCUMENTS 4,402,201 A * 9/1983 Nokes ..... E05B 19/00 70/395
7,278,465 B1 * 10/2007 McGuire ..... B22C 9/04 164/35
9,205,500 B2 * 12/2015 Haake ..... B23P 15/005

FOREIGN PATENT DOCUMENTS

DE WO 2012062305 A2 * 5/2012 ..... B23P 15/005

* cited by examiner

*Primary Examiner* — Kevin E Yoon

(74) *Attorney, Agent, or Firm* — Patricia Mathers; Jeffrey Joyce

(57) ABSTRACT

A method for coding components of a locking system which are used to code a key and a female lock part. The coding components may be formed integrally with the key and female lock part or be provided as coding discs that are then affixed to non-coded bodies used for the key and female lock part. A blank of an easily machinable preliminary material is separated into two coding parts with a separation cut that simultaneously creates a coding surface on each coding part. These coding parts serve as the model to mold the coding components in a lost-wax process. Each coding part is encased in a material that forms a mold shell. The coding part is then melted or gasified and escapes from the mold shell, which now has a mold cavity that is then cast with the final material to be used for the coding components.

6 Claims, 2 Drawing Sheets

METHOD FOR PRODUCING CODING SURFACES FROM A BLANK

BACKGROUND INFORMATION

Field of the Invention

The invention relates to the field of lock systems. More particularly, the invention relates to a method of producing coding parts for a key and mating female lock part.

Discussion of the Prior Art

WO 2012/062305 A2 discloses a conventional method for coding a lock. A blank is cut into two parts by means of a separation cut. The cut makes several changes in direction, thereby creating two mating coded surfaces. These two parts with mating coded surfaces are referred to hereinafter as coded parts.

DE 196 36 135 C1 discloses a method for castings in which initially a blank is created that is then referred to as the "pattern". A mass is applied to the pattern to create a first casting mold that has a hollow inner space that corresponds to the shape of the pattern. Melted wax is poured into this first casting mold and hardens to a solid wax model for the final object. The wax model, after it has hardened and set, is coated with ceramic material, which sets to a dimensionally stable shell around the wax pattern. The wax is then removed from the shell by melting it and letting it drain out of the shell, so that a second, this time ceramic casting mold remains. A molten casting material is filled into this second casting mold. After the casting material has hardened, the ceramic casting mold is destroyed, thereby obtaining a model made of the casting material that corresponds in shape to the original pattern.

What is needed, therefore, is an improvement of the conventional method that makes it possible to produce keys and female lock parts for locking systems in a particularly cost-effective manner.

BRIEF SUMMARY OF THE INVENTION

The method according to the invention of producing coding parts for keys and female lock parts or female lock parts comprises using a blank made from a preliminary material, one that is easy to machine, machining the coding surfaces into the blank, and then using the lost-wax process to create the end products, i.e., the key and female lock part with the coding surfaces or the coding components that are bonded to the key and the female lock part.

In other words, the method according to the invention does not use a blank from the same material that is used for the end products, i.e., a metal. This method appears at first glance to be more complicated than the conventional process that is used to make the key and the female lock part, but surprisingly, it results in reduced costs in the production of the end products, because it allows the use of simplified, less expensive tools and reduces the time required to machine the coding surface.

In a first step, two mating coding parts, one for the key and one for the female lock part, are created from a blank by means of a separation cut. The material that is used for this blank and, thus, also for the two coding parts, is referred to hereinafter as a "preliminary material," in this case, is a wax or a plastic foam. The coding parts made from this preliminary material are then used as positive models to create negative molds, a process that is known in the field of fine casting as the lost-wax process. The material that is used for the end products, on the other hand, is a metal or metal alloy, and is referred to hereinafter as the "final material." Metal materials, because of their hardness, strength, and resistance to material removal, require expensive tools and significant effort to machine them.

In the next step, the two coding parts are encased in a material that is eventually dimensionally stable to create a mold shell. The material selected for the mold shell has a higher melting point than the preliminary material of each coding part and also has a higher melting point than the final material that is going to be used to form the end products.

The mold shell is intentionally created with one or more open spaces that leave the coding part inside the shell exposed, i.e., not covered by the shell. The coding part is subsequently heated to a temperature that is above its melting temperature, but to a temperature at which the mold shell still maintains dimensional stability. The preliminary material of the coding part, depending on the material used, melts or gasifies, and flows or escapes from the mold shell through the open space(s). The mold shell now has a hollow chamber that corresponds precisely to the shape of the coding part. One or more additional open spaces may possibly be provided to facilitate a complete emptying of the shaped hollow chamber.

The mold shell is now cast with the final material, i.e., with the material that is to be used to form the coding component that provides the coding surface on the finished key or female lock part. The open space serves thereby as the gate for pouring the final material into the shell. One or more additional open spaces may be provided to serve as vents for the shaped hollow chamber, as a means of ensuring that the chamber is completely filled in the pouring step. Two coding components are thus created as castings that correspond in shape to the two coding parts previously created from the blank.

The method according to the invention is a two-part process: First, the separation cut is done on the blank to create two coding parts that have the desired mating coding surface. This is done using the preliminary material that is easy to machine. Then, the coding components that are actually used in the lock system are produced, using the final material.

The molding and casting steps may be done sequentially or simultaneously, depending on the preliminary material used. When using wax as the preliminary material, the steps are done sequentially, first removing the coding part from the mold shell by melting it and then casting the shaped hollow chamber with the final material that is to be used. These steps may be implemented fully independently of each other, for example, by initially creating the mold shell by melting an existing wax coding part, heating the coding part so that the liquid wax flows out of the mold shell, and then, at a later time, pouring the liquid metal into the mold shell to obtain the component made of the final material.

If a plastic foam material is used as the preliminary material, these steps may, however, be done practically simultaneously. The mold shell is formed around the foam coding part and, once the mold shell has solidified to its dimensionally stable form, molten metal into the mold shell without first removing the coding part. The temperature of the molten metal is several hundred degrees Celsius and at this temperature, the plastic foam gasifies as the molten metal is poured into the shell, and the gasified material including the large volume of air in the pores of the foam escape through the open space(s) in the shell.

The entire key or the entire female lock part may be cast with the final material so that the coding surface is integrally formed with the key or female lock part. In other words, the coding part may have the shape of the key or the female lock part, including the respective coding surface. Alternatively, however, standard basic bodies for the key and the female lock part may be used to initially produce and stock a large number of keys and female lock parts that have no coding. Coding discs are then created with the method according to the invention and then bonded to the standard basic bodies to provide the unique coding on the particular key and female lock part. Use of these basic bodies with coding discs is disclosed in WO 2012/062305 A2, which is herein incorporated in its entirety.

The method according to the invention, i.e., making the coding parts from a preliminary material and then creating the castings of the coding components, describes a circuitous approach in the production of the end products, i.e., the key and the female lock part of a locking system. Surprisingly, it was found that this circuitous approach significantly simplifies the process of making the key and female lock part and has a positive effect on the production costs. This is because significantly simpler tools may be used to separate a blank made of preliminary material into two coding parts. The preliminary material for the blank is one that is particularly resistance-weak, i.e., particularly easy to machine. For example, the separation cut on a blank constructed as a wax body may be done with a heated rod or wire, because the wax offers little resistance.

The coding parts produced in this way from a wax blank may then be used with the lost-wax method, whereby the blank is lost in the process, because it flows as molten wax out of the mold shell. For security reasons, the coding in a lock system is typically used only once, i.e., each key and female lock part has a unique coding, and for this reason, it is not a disadvantage that the two coding parts are lost in the process. The method according to the invention maintains the advantage of the conventional process, i.e., simultaneously creating two complementary coding surfaces with a single separation cut.

As mentioned above, wax is not the only preliminary material that may be used to make the blank. A plastic foam, such as expanded polystyrene, is also a suitable material for the blank, because this material is also easy to machine, and with simple tools. The separation cut on a plastic foam blank may also be done with a heated rod or wire. A metal or ceramic rod, for example, may be a suitable tool. These kinds of tools offer definite cost advantages. For example, if the tool is a metal wire and the tool fails, it can be replaced by a new wire in a very short time and at very little cost. Thus, the production of the two coding parts may be done in a very short time span and at reduced production costs.

By contrast, the conventional method of machining a separation cut in a blank made of metal is time consuming and costly. Machining away metal material takes time. Electric spark machining requires sophisticated equipment. If the separation cut through a metal blank is to be done with a saw, then the multiple changes in direction in making the cut exert significant mechanic loading on the saw blade, reducing the service life of the saw blade. Compared to these conventional methods for machining metal, the ability to use a resistance-weak, i.e., easily machinable, material for the blank, as suggested in this method according to the invention, provides significant savings in time and cost and, in the end, simplifies of the process of manufacturing keys and female lock parts.

Advantageously, the mold shell around the coding parts may be made in a conventional manner. Thus, the material used for the mold shell is one that is initially deformable, so that it is able to optimally conform to the precise contours of each coding part, but then sets or hardens to a dimensionally stable, rigid form. A ceramic slurry is a suitable material that is applied to the coding part as a slurry and then hardens to a rigid form. The ceramic material has a high melting point, so that, after hardening, it remains stable, even when molten metal is poured into the hollow chamber. It may be desirable to accelerate the hardening process by making a ceramic mold shell that has relatively thin walls. In order to ensure sufficient mechanical or shape stability, this thin-walled mold shell may then be embedded in a supporting mass, for example, in sand. Or the thin-walled mold shell may be created with a defined outer shape and a support shell then be inserted into it, whereby the support shell has retaining chamber that is adapted to the defined outer form of the mold shell.

A computer-controlled cutting tool may be used to do the separation cut in the blank. The necessary data for the contour of the separation cut, which also describes the topography of a coding surface, is stored digitally in a computer. The advantage of using a computer-controlled system is that the coding surfaces are reproducible multiple times, easily and with great repeat accuracy. This is an advantage when having to provide replacement parts, or when multiple authorized persons are to be given identical keys, in order to actuate the same female lock part. It is also possible that two identically coded lock systems are to be used. For example, a multinational corporation may have two lock systems installed as stationary systems in two places that are geographically far apart from each other, but are to be identically coded. In this case, use of a computer-controlled tool system for the separation cut reduces the costs of creating multiple identically coded lock systems.

BRIEF DESCRIPTION OF THE DRAWINGS

The present invention is described with reference to the accompanying schematic representations. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
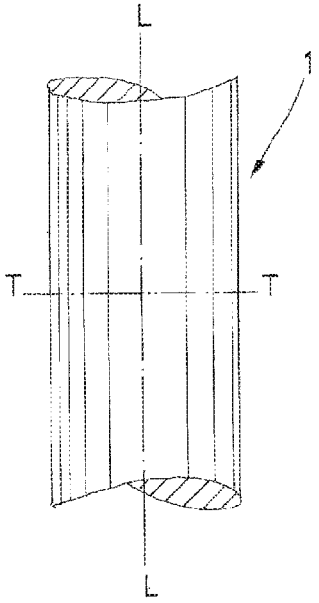
FIG. 1 illustrates a blank.
Figure 2:
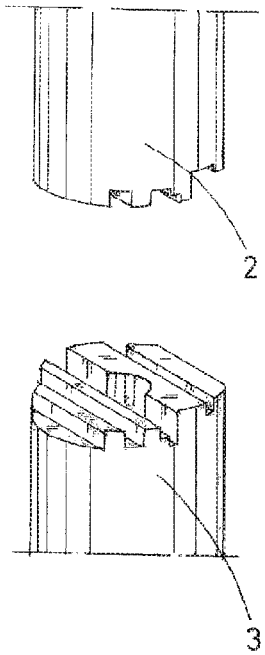
FIG. 2 illustrates the separation cut carried out on the blank of FIG. 1 to obtain two mating coding parts.

FIG. 1 shows a blank 1 that is made of wax. The blank 1 is constructed as a simple rod with a cylindrical cross-section. A separation plane T-T is drawn across the blank, transverse to a longitudinal axis L-L of the blank 1. FIG. 2 illustrates a separation cut that is cut into the blank 1, generally along the separation plane T-T, to create two coding parts 2 and 3. The separation cut does not extend in a straight line along the separation plane, but rather, has a plurality of changes in direction, both transverse and parallel to the longitudinal axis L-L of the blank 1, to create a uniquely formed coding surface. The two cut surfaces created by the separation cut form mating coding surfaces on the coding parts 2 and 3. As used hereinafter, coding part 2 designates the coding part of a key 4 and coding part 3 designates the coding part of a female lock part 5.

Figure 3:
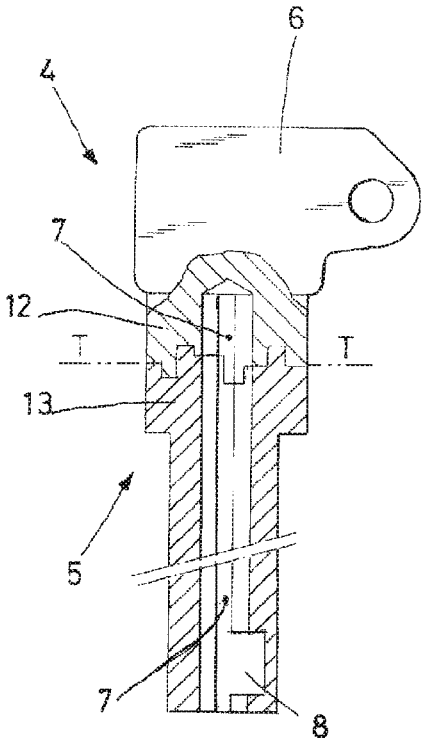
FIG. 3 illustrates two coding parts, shown here as a key and a female lock part, fitting together.
Figure 4:
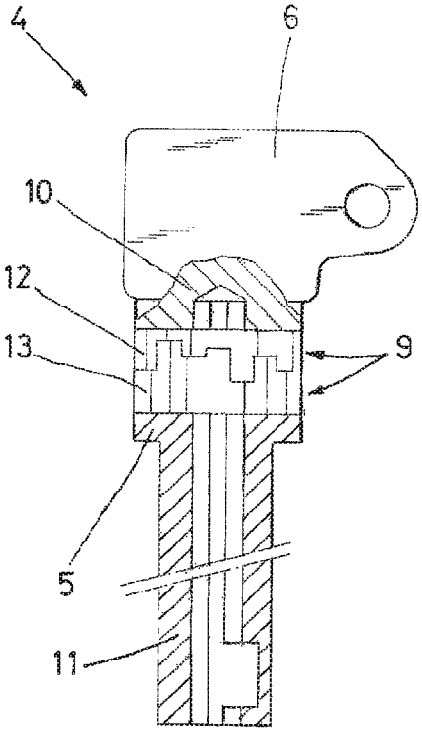
FIG. 4 illustrates two coding parts, shown here as coding discs bonded to the key and female lock part, fitting together.

FIGS. 3 and 4 illustrate two ways of providing coding on the respective key 4 and female lock part 5. FIG. 3 shows that a coding component 12, which was made as a casting of the coding part 2, is an integral part of the key 4 to which a key grip 6 has been added, and that a coding component 13, which was made as a casting of the coding part 3, is an integral part of the female lock part 5. The female lock part 5 has a central bore 7 and a recess 8 that extends radially outward from the central bore 7, that are dimensioned to receive a lock bolt and a radially outwardly projecting key bit of the key 4, such as is known in the field of locks. The contours of the separation cut on the coding parts 2 and 3 have been precisely reproduced on the coding components 12 and 13 and as can be seen in FIG. 3, they fit precisely to each other.

The coding components 12 and 13 that are shown in FIG. 4 are significantly smaller, disc-shaped coding components than those shown in FIG. 3. In this case, the coding components 12 and 13 are referred to as coding discs 9 and the components used for the key and female lock part are standard, non-coded bodies 10 and 11, respectively. The use of the coding discs 9 that are bonded to standard bodies provides significant advantages in the production of keys and female lock parts for locking systems. First of all, the amount of time to encase the coding parts 2 and 3, as well as to subsequently cast and cool the coding components 12 and 13, is significantly shorter when smaller components, such as discs, are used, rather than the full female lock part or key component. The standard non-coded bodies 10 and 11 may be produced in large volumes as standard components and then be processed into finished coded pairs of the key 4 and the female lock part 5 as needed, by affixing the corresponding mating coding components 12 and 13 to the key body 10 and the female lock part body 11.

The method according to the invention to produce the coding components 12 and 13, whether they be constructed as coding discs 9 or integrally formed with the key 4 of the female lock part 5, is now explained in detail with reference to the FIGS. 5-7.

Figure 5:
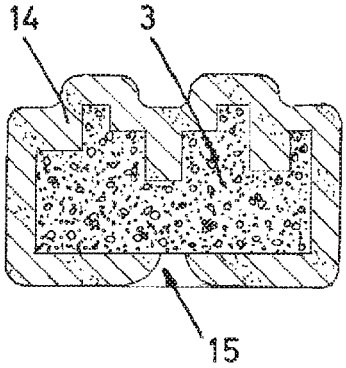
FIG. 5 illustrates a coding part encased in a mold shell.

FIG. 5 shows the coding part 3 similar to the one shown in FIG. 2, but with the difference that this coding part 3 is constructed as the relatively flat coding disc 9 shown in FIG. 4. The coding part 3 is made from a preliminary material that enables a resistance-weak machining of the blank 1 by means of the aforementioned separation cut. For example, the blank 1 and, thus, the coding part 3 are made of wax or a foamed plastic material. The coding part 3 is encased in an envelope or mold shell 14, which, for example, is applied as a slurry or liquid to the coding part 3 and then dried and hardened, so that the mold shell now has a dimensionally stable, rigid form. An open space 15 is provided in the mold shell 14, such that the coding part 3 is exposed at this opening. Only one open space 15 is shown in the drawing, but it is understood, that additional open spaces may be provided in the mold shell 14.

The melting point of the coding part 3 is lower than the melting point of the mold shell 14 and, because of that, the coding part 3 may be heated to a liquid state, while the mold shell 14 maintains its shape. Thus, if the coding part 3 is made of wax, heat is applied to the melting point of the wax, which then flows out of the mold shell 14 through the open space 15. If the coding part 3 is made of polystyrene foam, heat is applied to the point of gasifying the foam, so that the gasified material and the air from the pores escape through the open space 15.

Figure 6:
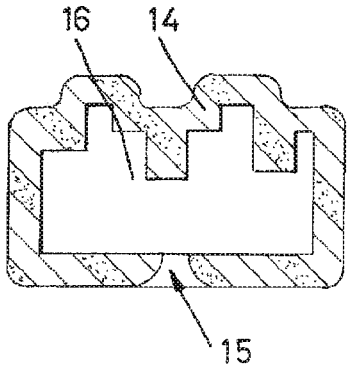
FIG. 6 illustrates the dimensionally stable mold shell after the coding part has been removed.

FIG. 6 shows the mold shell 14 after the coding part 3 has been lost. The mold shell 14 has remained dimensionally stable and now has a shaped hollow chamber 16 that corresponds precisely in shape to that of the coding part 3.

Figure 7:
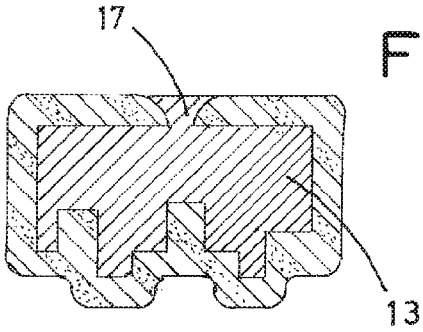
FIG. 7 shows the mold shell of FIG. 6, up-ended and filled with the final material for the coding components.

FIG. 7 shows the mold shell 14 up-ended, so that the open space 15 faces upward. In this orientation, a flowable or molten material may be poured into the shaped hollow chamber through the open space 15. It may be preferable to provide one or more additional open spaces that serve as vents. The flowable material is, for example, a molten metal alloy, so that the coding component 13 that is produced corresponds to the shape of the coding part 3, but is made of a material that has the strength and durability properties that are desirable for components of a lock system. Thus, the initial coding part 3 is made from a material that is easy to machine, has a relatively low melting point, and is resistance-weak to abrasion and pressure, whereas the coding component 13 is made from a mold of the coding part 3 with the final material that has the temperature stability, mechanical abrasion resistance, pressure resistance, and other properties that are desirable for components of the lock system. Any gates or sprues 17 that are formed on the coding component 13 are subsequently removed, so that the coding component 13 now has the form shown in FIG. 4 and, when bonded to the standard female lock part body 11, forms the coded female lock part 5.

It is understood that the embodiments described herein are merely illustrative of the present invention. Variations in the method of constructing the coding components for a key and female lock part may be contemplated by one skilled in the art without limiting the intended scope of the invention herein disclosed and as defined by the following claims.

What is claimed is:

1. A method of coding a key and a female lock part for a lock system, the method comprising the steps of:

a) providing a blank made of a preliminary material that is easy to machine, the preliminary material having a preliminary-material melting point;

b) separating the blank with a separation cut to obtain two coding parts, a key coding part and a female lock part coding part, the blank having a longitudinal axis and the separation cut having multiple changes in direction that are transverse and parallel to the longitudinal axis, so that each coding part has a coded surface that mates with a coded surface of the other coding part;

c) encasing each coding part in a shell material that becomes dimensionally stable to form a mold shell and that has that a shell-material melting point that is higher than the preliminary-material melting point;

d) providing an open space in the shell material, such that the coding part is not covered with the shell material at the open space;

e) heating the coding part at least to the preliminary-material melting point but to a temperature lower than the shell material melting point, thereby allowing the coding part change from a solid state to a flowable state and to be removed from the mold shell through the open space, thereby leaving a mold shell with an inner shaped chamber that corresponds in shape to that of the coding part; and f) pouring a material into the mold shell, the material being suitable to form a coding component on the key or the female lock part.

2. The method of claim 1, wherein the shell material is initially deformable when it is applied to the coding part and is then hardened to a the dimensionally stable state.

3. The method of claim 1, wherein the blank is made of wax.

4. The method of claim 1, wherein the blank is made of a foamed plastic material.

5. The method of claim 1, wherein a heated rod is used to carry out the separation cut.

6. The method of claim 1, wherein the two coding parts are constructed as a key coding disc and a lock-plug coding disc, wherein an uncoded standard body is used for the key and the female lock part, respectively, and wherein the key coding disc is affixed to the standard body for the key and the lock-plug coding disc affixed to the standard body for the female lock part.

* * * * *